US009155952B2

(12) United States Patent
Yamanashi

(10) Patent No.: US 9,155,952 B2
(45) Date of Patent: Oct. 13, 2015

(54) TENNIS TRAINING APPARATUS

(76) Inventor: Tatsuya Yamanashi, Kawasaki (JP)

( * ) Notice: Subject to any disclaimer, the term of this patent is extended or adjusted under 35 U.S.C. 154(b) by 107 days.

(21) Appl. No.: 13/514,243

(22) PCT Filed: Dec. 10, 2009

(86) PCT No.: PCT/JP2009/070665

§ 371 (c)(1),
(2), (4) Date: Jul. 26, 2012

(87) PCT Pub. No.: WO2011/070662

PCT Pub. Date: Jun. 16, 2011

(65) Prior Publication Data

US 2012/0283046 A1 Nov. 8, 2012

(51) Int. Cl.

| | |
|---|---|
| ***A63B 69/38*** | (2006.01) |
| ***A63B 69/00*** | (2006.01) |
| ***A63B 63/00*** | (2006.01) |

(52) U.S. Cl.

CPC ..... *A63B 69/0097* (2013.01); *A63B 63/00* (2013.01); *A63B 69/38* (2013.01); *A63B 2063/001* (2013.01); *A63B 2210/50* (2013.01)

(58) Field of Classification Search

CPC .. A63B 69/38; A63B 63/00; A63B 2063/001; A63B 2243/0075

USPC ..... 273/395, 396, 398–402; 473/197, 434, 473/435, 459, 462

See application file for complete search history.

(56) References Cited

U.S. PATENT DOCUMENTS

| | | | | | |
|---|---|---|---|---|---|
| 1,658,097 | A | * | 2/1928 | Pierce | 273/395 |
| 2,174,884 | A | * | 10/1939 | Kachel | 473/434 |
| 3,180,643 | A | * | 4/1965 | Kallai | 473/434 |
| 3,420,528 | A | * | 1/1969 | Day | 473/157 |
| 3,697,068 | A | * | 10/1972 | McDougall | 473/434 |
| 3,989,246 | A | * | 11/1976 | Brown et al. | 473/431 |
| 4,373,720 | A | * | 2/1983 | Lombardi et al. | 473/434 |
| 4,417,728 | A | * | 11/1983 | Hay et al. | 473/435 |
| 4,592,547 | A | * | 6/1986 | Thaxton | 473/462 |
| 4,615,528 | A | * | 10/1986 | York | 473/432 |
| 4,824,108 | A | * | 4/1989 | McLean | 473/474 |
| 5,306,009 | A | * | 4/1994 | Bolanos | 473/157 |
| 5,609,528 | A | * | 3/1997 | Kehoe | 473/157 |
| 6,082,736 | A | * | 7/2000 | Barlow | 273/317.1 |
| 6,213,900 | B1 | * | 4/2001 | Steyn et al. | 473/434 |

(Continued)

FOREIGN PATENT DOCUMENTS

| | | |
|---|---|---|
| EP | 0 220 111 A2 | 4/1987 |
| JP | 56500005 | 1/1981 |
| JP | 58117667 U | 8/1983 |
| JP | 58153871 | 10/1983 |

(Continued)

*Primary Examiner* — Mark Graham

(74) *Attorney, Agent, or Firm* — Haverstock & Owens LLP

(57) ABSTRACT

A tennis training apparatus is provided with a sheet supporting frame to be installed in a training place; a hit ball receiving sheet supported by the sheet supporting frame rises in an inclination state toward a distal end thereof; and a turning guide portion provided at an upper end of the hit ball receiving sheet in an eave shape curved toward a near side. When a ball hit by a player is received by the hit ball receiving sheet, the ball is turned by the turning guide portion to move downward along the hit ball receiving sheet and fly out of the hit ball receiving sheet as a returning ball. The returning ball bounces to return near the player. The hit ball receiving sheet is provided with a returning hit ball guiding structure where the player can select from one or more preferable hitting-back positions.

5 Claims, 8 Drawing Sheets

(56) References Cited

U.S. PATENT DOCUMENTS

| | | | | |
|---|---|---|---|---|
| 7,201,675 | B2 * | 4/2007 | Morrison | 473/434 |
| 7,597,558 | B2 * | 10/2009 | Mazloompour | 434/247 |
| 8,016,700 | B2 * | 9/2011 | McTavish et al. | 473/459 |
| 2013/0072327 | A1 * | 3/2013 | Hunt | 473/434 |

FOREIGN PATENT DOCUMENTS

| | | | |
|---|---|---|---|
| JP | 58188078 | | 12/1983 |
| JP | 9262330 | | 10/1997 |
| WO | 98/07477 | A1 | 2/1998 |

* cited by examiner 2
30
301
3
20
302
S
31
303
4
A
21
23
11
26
33A(33)
13
331(33A)
10
25
1

TENNIS TRAINING APPARATUS

TECHNICAL FIELD

This invention relates to a tennis training apparatus, and in particular to a novel structure which produces a significant effect in improvement of an actual hitting skill of a player.

In general, when a player conducts a tennis-hitting training alone, he/she adopts such a method as to train by hitting a ball against a vertical wall face to hit a returning ball back again or hitting a ball attached to a stretchy string. However, in such a method, it is difficult to achieve an actual hitting-training effect sufficiently, and a training environment is further limited because a vertical wall face suitable for hitting a ball does not exist near the player.

From these circumstances, as a tennis training apparatus which can be installed at a proper place, for example, such an aspect that by installing a hit ball receiving sheet in an obliquely-spread state thereof in front of a training player and forming an eave-like turning guide portion curved toward the near side of the player in an upper end portion of the hit ball receiving sheet in side view, a hit ball hit toward the hit ball receiving sheet is guided to return to the turning guide portion at the upper portion, the ball returns downward along the hit ball receiving sheet as a return hit ball and the returned hit ball is hit back when the ball is bounded from a ground or a floor face again has been proposed (Patent Literatures 1, 2 and 3).

In these proposals, however, a special effort is not actually adopted for returning of the returning hit ball from the hit ball receiving sheet, so that unless a setting angle of the hit ball receiving sheet to a base face is changed, the returning hit ball always flies out of the hit ball receiving sheet at a constant angle and it bounds at the same place. As a result, a player always hits a ball back at the same place, so that an actual upskilling effect cannot be achieved sufficiently.

The condition for upskilling is required to satisfy that variation of the returning hit ball can be freely selection and that an elevation angle of the hit ball at a time of hitting the ball back can be tried properly, specifically, the condition is required to satisfy that a hit ball with a fast speed from a high hitting point (a hitting-back point) or a low hitting point or a hit ball with a slow speed from a high hitting point or a low hitting point can be obtained, and the hit ball receiving sheet is sufficiently spread such that even if the elevation angle of the hit ball is changed, the ball receiving sheet is prevented from failing to catch the hit ball.

However, as described above, the conventional methods are not provided with a configuration which can expect such an effect.

Patent Literature 1: Utility Model Application Laid-Open No. S58-153871

Patent Literature 2: Utility Model Application Laid-Open No. S58-117667

Patent Literature 3: Utility Model Application Laid-Open No. S58-101674

DISCLOSURE OF THE INVENTION

Problem to be Solved by the Invention

The present invention has been made in view of these various backgrounds, and a novel tennis training apparatus has been developed which, in addition to acquisition of a right hitting form, allows a player to conduct a higher training regimen.

Means for Solving the Problem

A tennis training apparatus is provided with a sheet supporting frame which can be installed in a proper training place; a hit ball receiving sheet supported by the sheet supporting frame so as to spread in an inclination state rising toward a distal end thereof; and a turning guide portion provided at an upper end of the hit ball receiving sheet in an eave shape curved toward a near side in side view, where after a hit ball which has been hit by a player is received by the hit ball receiving sheet, the ball is turned by the turning guide portion to move downward along the hit ball receiving sheet and fly out of the hit ball receiving sheet as a returning hit ball and the returning hit ball bounds on a base face of the training place to return near the player again, and the player can continue a hitting training by hitting the returning ball back again, wherein the hit ball receiving sheet is provided with a returning hit ball guiding structure where the player can select one from some preferable hitting-back positions.

In some embodiments, the returning hit ball guiding structure is a first guiding structure which changes setting of a spreading face of a region of the hit ball receiving sheet near a lower end portion thereof to a valley fold to the spread face of the hit ball receiving sheet.

In some embodiments, the first guiding structure is a guiding plate with a fixed rigidity provided near the lower end portion of the hit ball receiving sheet.

In some embodiments, the returning hit ball guiding structure includes an upper face guide sheet covering the upper face of the hit ball receiving sheet in a widthwise direction of the hit ball receiving sheet, and the upper face guide sheet is set at an angle shallower than a spreading angle of the hit ball receiving sheet and has a second guiding structure where a distal end edge of the upper face guide sheet allows a hit ball passing through a lower face of the upper face guide sheet while contacting with the hit ball receiving sheet to pass through the lower face of the upper face of the upper face guide sheet and allows the returning hit ball to pass through an upper face of the distal end edge.

In some embodiments, the turning guide portion is composed of an upper end portion of the hit ball receiving portion spread in an eave-like shape curved in side view.

In some embodiments, the turning guide portion is formed of a hard material having a large coefficient of restitution.

In some embodiments, the turning guide portion is provided with a reflection guide portion changing a returning direction of the returning hit ball.

In some embodiments, the deflection guide portion is provided near one or each of both of left and right end portions of the turning guide portion in a widthwise direction of the turning guide portion.

Effect of the Invention

In some embodiments, the hit ball receiving sheet is provided with the returning hit ball guiding structure, and the returning hit ball is bounded near the player spaced from the tennis training apparatus by a fixed distance to be returned to the player. As a result, the player can always master an accurate hitting form.

In some embodiments, by changing a spreading degree of a lower end region of the hit ball receiving sheet, the returning hit ball can be guided to a desired direction, a structure of the apparatus is made simple, and setting desired by the player can be achieved easily.

Since the returning hit ball guiding structure uses the guide plate with a fixed rigidity, a rate of reduction of the speed of the returning hit ball is reduced, and an accurate ball-returning state can be obtained.

Since the upper face guide sheet covering an upper face of the hit ball receiving sheet in a widthwise direction of the hit ball receiving sheet is used, the returning hit ball is guided by the upper face guide sheet to drop from a high position, the returning hit ball which has eventually bounded highly becomes a gentle speed so that such a situation that a beginner trains easily can be obtained.

Since the turning guide portion provided at the upper end of the hit ball receiving sheet is formed by spreading the upper end portion of the hit ball receiving sheet in an eave shape, the tennis training apparatus is provided based upon a simple configuration.

Since the turning guide portion is formed of a hard material with a high coefficient of restitution, the momentum of the hit ball is not reduced even by the turning guide portion which tends to reduce the momentum of the hit ball so that a powerful returning hit ball is obtained as if the returning hit ball is bounded on the turning guide portion. Accordingly, even a skilled player can conduct sufficient and satisfactory training.

In some embodiments, the turning guide portion is provided with the deflection guide portion for changing the returning direction of the returning hit ball and the hit ball is deflected in an unexpected direction when it is turned, so that the returning direction of the returning hit ball is not constant. Therefore, the player can master left and right movements in response to the returning direction of the returning hit ball, so that even an advanced player can take a training aspect suitable therefor.

In some embodiments, the deflection guide portion is provided on each of left and right end portions of the turning guide portion, and when a player hits a ball while aiming a corner portion of the turning guide portion, it is expected that a returning hit ball is returned while a returning direction thereof is changed, so that an advanced player can train further effectively in such a fact that the direction of the returning hit ball is hard to be set according to a target setting of a hitting position.

EMBODIMENT FOR CARRYING OUT THE INVENTION

A best mode for carrying out the present invention includes an embodiment described below as one thereof, and the present invention includes various improved embodiments based upon the technical idea of the present invention.

First Embodiment

A tennis training apparatus A of the present invention will be specifically described below with reference to illustrated embodiments.

Figure 1:
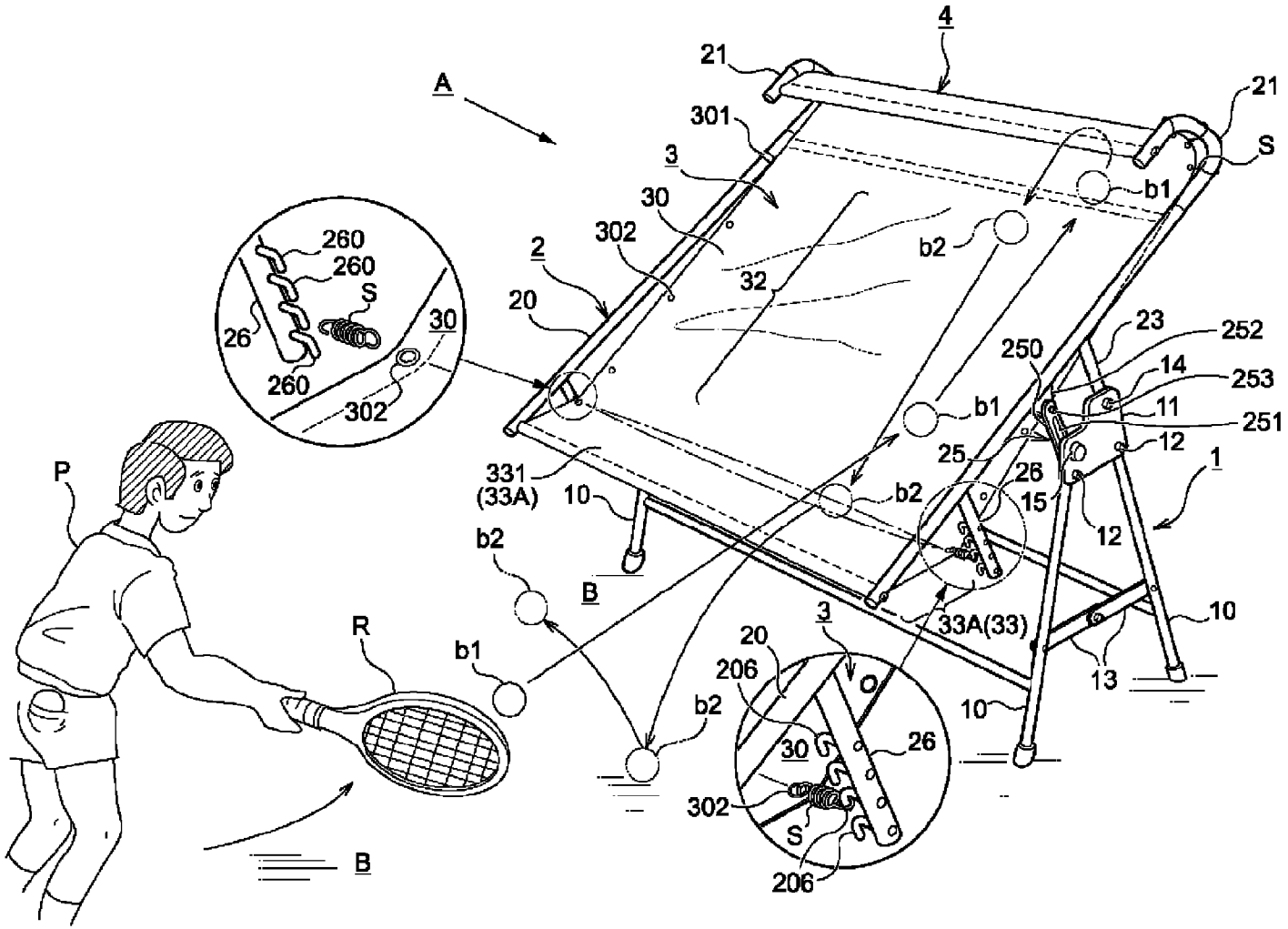
FIG. 1 is a perspective view showing a usage situation of a tennis training apparatus of the present invention where a connection state between guiding stays and a hit ball receiving sheet is also shown in a partially enlarged view.
Figure 2:
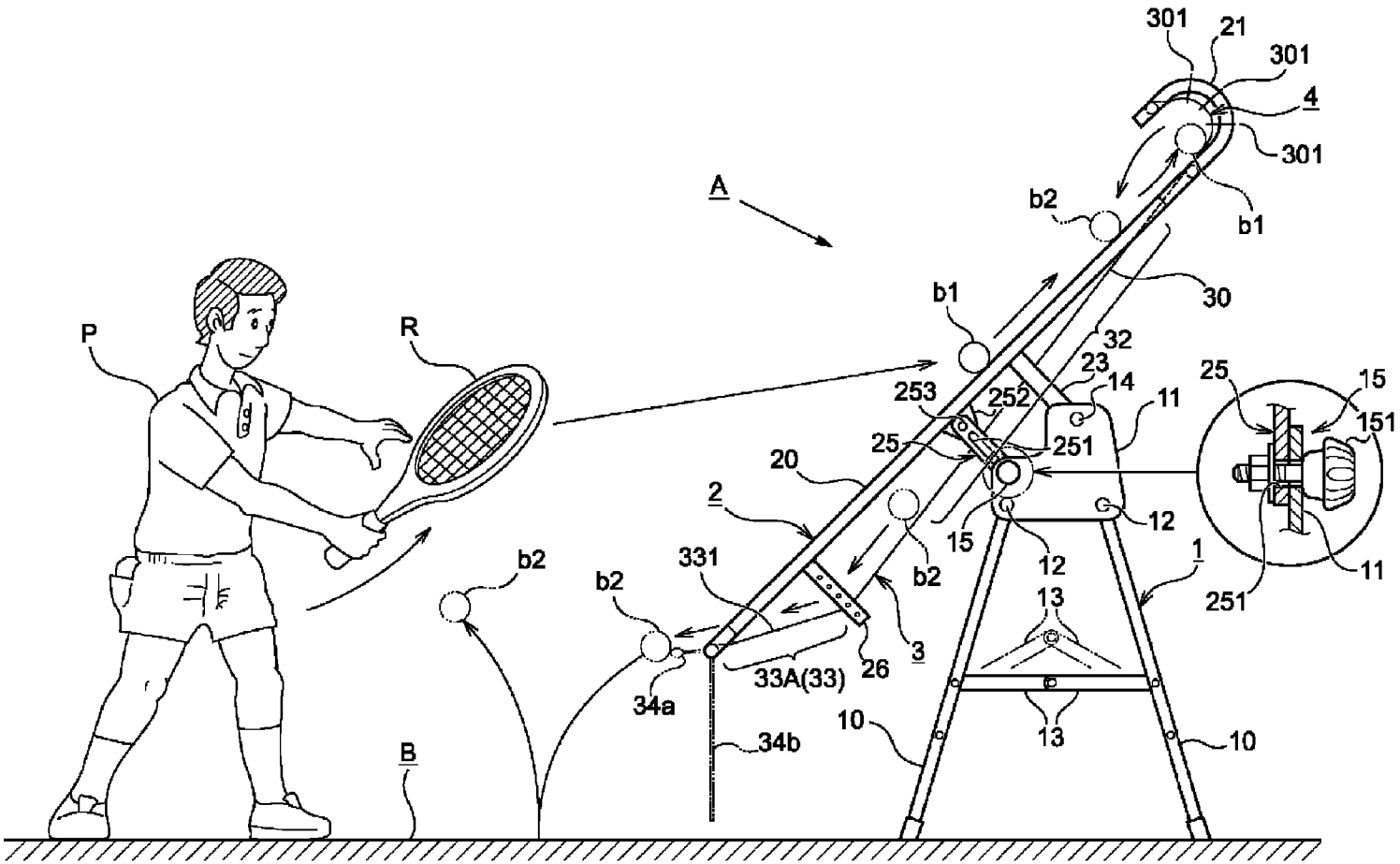
FIG. 2 is a side view of the usage situation shown in FIG. 1, where a connection state of a frame-adjusting fulcrum is also partially shown in a partially sectioned enlarged view.

The tennis training apparatus can be properly installed at an indoor or outdoor training place to be used, and a ground face or a floor face where the tennis training apparatus is installed is defined as a base face B. As shown in FIGS. 1, 2 and 3, a main configuration of the tennis training apparatus is such that a frame-shaped sheet supporting frame 2 is attached to a proper base stand 1 in an inclination state thereto, a hit ball receiving sheet 3 is further provided to the sheet supporting frame 2 in a spreading manner, a turning guide portion 4 is provided at an upper portion of the hit ball receiving sheet 3, and a first guiding structure 33A constituting a returning hit ball guiding structure 33 is provided at a lower portion of the hit ball receiving sheet 3, as one example.

With such a configuration, a hit ball b1 hit with a racket R by a player P is received by the hit ball receiving sheet 3, an advancing direction of the ball is changed by the turning guide portion 4, the ball drops along the hit ball receiving sheet 3 as a returned hit ball b2 again, the ball is guided by the first guiding structure 33A to fly out of the hit ball receiving sheet 3, the ball bounds on the base face B near the player P again, and the player P hits the bounded returned hit ball b2 again. The player P trains by repeating such a sequence.

Respective members of the tennis training apparatus will be described below in detail.

First of all, the base stand 1 is composed of pipes such as metal pipes, resin pipes, or pipes made of a composite material of the metal or resin, and it is provided with leg portions 10 opened back and forth in side view. A pair of left and right frame supporting brackets 11 is provided on upper ends of the leg portions 10. The frame supporting bracket 11 is connected to upper ends of a pair of leg portions 10 in an openable and closable manner at leg top portion fulcrums 12. Further, a leg brace 13 is provided at intermediate portions of each pair of leg portions 10 in a vertical direction, and the leg brace 13 is constituted to be foldable at a central portion thereof. On the other hand, the frame supporting bracket 11 further has a frame-fixing fulcrum 14 provided at an upper portion thereof and has a frame-adjusting fulcrum 15 provided at a position lower than the frame-fixing fulcrum 14.

A sheet supporting frame 2 is supported by such a base stand 1 in an inclination manner. The sheet supporting frame 2 is composed of pipes such as metal pipes, resin pipes, or pipes made of a composite material of the metal or resin, it is formed in a rectangular frame shape in front view, and a peripheral region of the sheet support frame 2 is defined as a peripheral frame portion 20. The peripheral frame portion 20 has turning frames 21 with a U shape in side view provided at upper ends thereof, and it is formed with fixing and connecting portions 23 connecting to the frame supporting brackets 11 in the base stand 1 so as to project downward. Further, adjusting and connecting portions 25 connected to the frame adjusting fulcrums 15 are provided near the respective fixing and connecting portions 23. Each adjusting and connecting portion 25 is specifically composed of a connecting plate 250 as a main member, and the connecting plate 250 is provided with a long hole for adjustment 251, and one end thereof is pivotally connected to a bracket 252 provided at the peripheral frame portion 20 via a pin 253.

Figure 7:
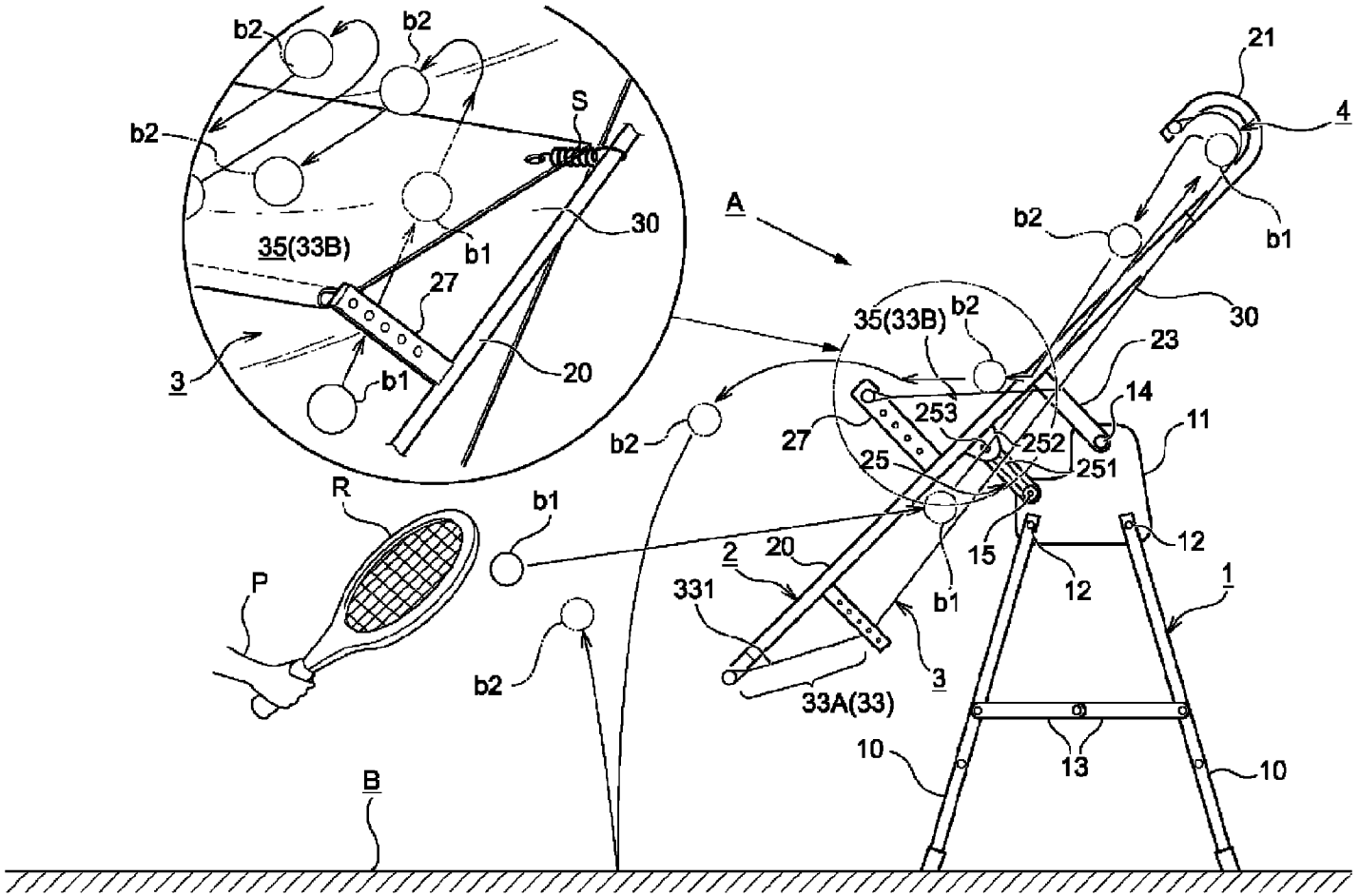
FIG. 7 is a side view showing routes of a hit ball and a returning hit ball.

A guiding stay 26 extending toward a lower face is provided at a lower portion of the peripheral frame portion 20, and it is formed with a plurality of adjusting hooks 260 arranged vertically. A stay for guide sheet 27 extending upward is provided at a portion of the peripheral frame portion 20 positioned slightly above the guiding stay 26 as needed, as shown in FIG. 7. Incidentally, functions of the guiding stay 26 and the stay for guide sheet 27 will be described later.

Such a sheet supporting frame 2 is fixed to the frame-fixing fulcrum 14 in the frame supporting bracket 11 of the base stand 1 at the fixing and connecting portion 23 utilizing a proper set of bolts and nuts or the like, and the connecting plate 250 is fixed to the frame-adjusting fulcrum 15 at the long hole 251, for example, utilizing a manually-rotatable fixing bolt 151 or the like. As understood from this configuration, by fixing a proper position in the long hole 251, the inclination state of the sheet supporting frame 2 can be set properly. Of course, a configuration for freely setting the inclination state is not limited to the long hole and a plurality of adjusting holes arranged in a multi-stage manner can be adopted.

Next, the hit ball receiving sheet 3 spread on the sheet supporting frame 2 will be described.

The hit ball receiving sheet 3 can be made of a resin sheet reinforced by synthetic resin fibers or the like, or a proper sheet material such as a so-called canvas sheet.

First, as shown in FIG. 3, the hit ball receiving sheet 3 includes a sheet main body 30 cut to a size slightly smaller than the sheet supporting frame 2 as a main member. The sheet main body 30 has mounting loops 301 and metal eyelets 302 at a peripheral portion thereof in order to attach the sheet main body 30 to the sheet supporting frame 2.

Figures 3A, 3B, 3C:
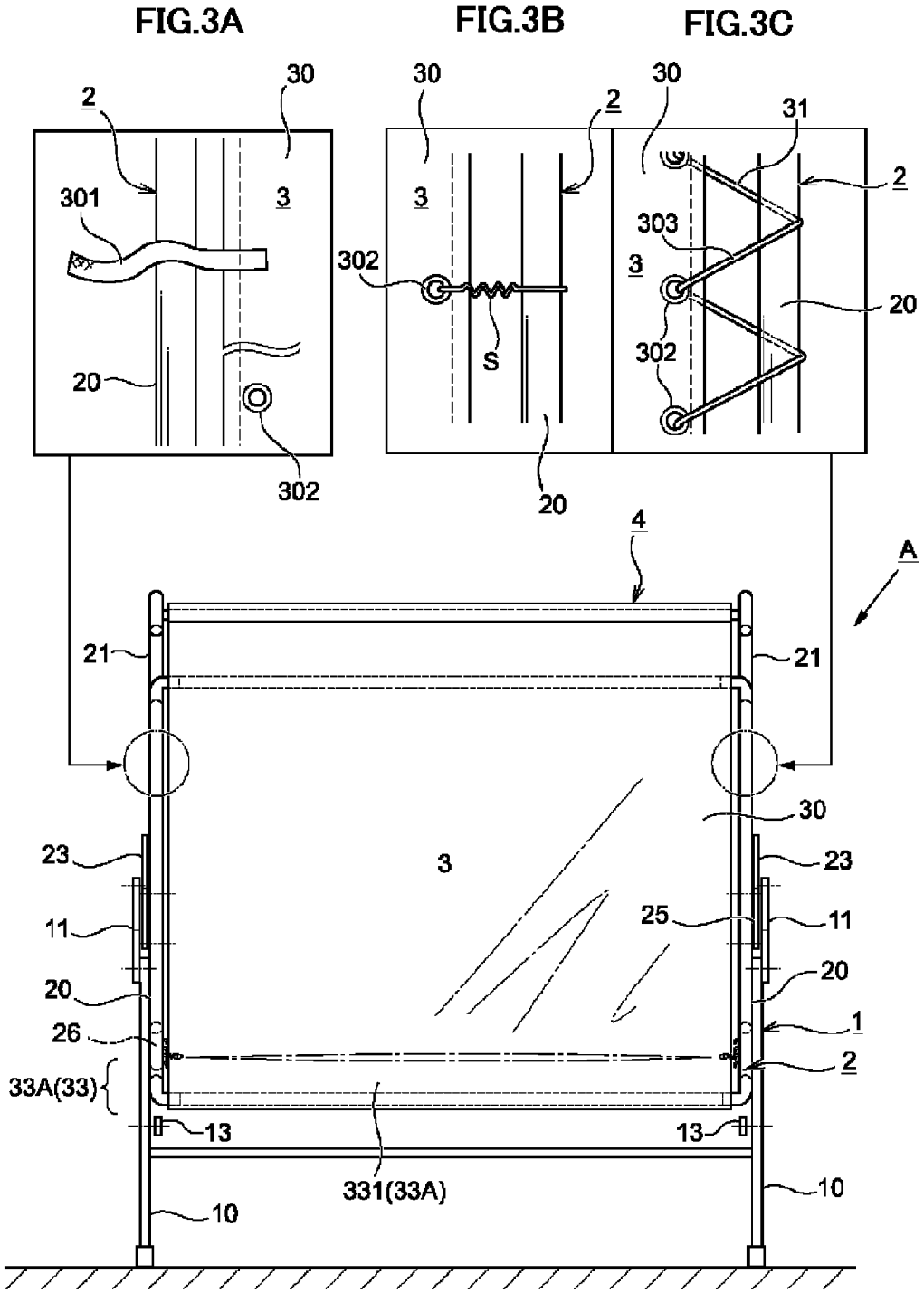
FIGS. 3A, 3B and 3C are front views of the usage situation shown in FIG. 1, where various connection states between a sheet supporting frame and the hit ball receiving sheet are shown in partially enlarged views.

As shown in FIGS. 3A to 3B, for attaching the sheet main body 30 to the sheet supporting frame 2, a proper method can be adopted, but such a method as attachment using face fasteners which allow adjustment of a length size (FIG. 3A), attachment using tensioning springs s (FIG. 3B), or knitting fixation of proper straps 3 into the eyelets 302 can be adopted.

Figure 4A:
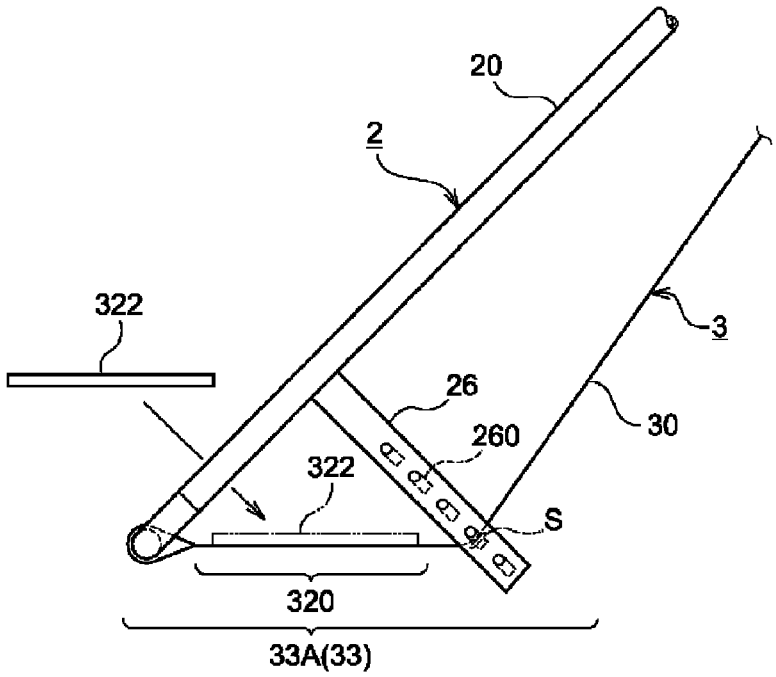
FIGS. 4A and 4B are side views showing a returning hit ball guiding structure, FIG. 4A being a side view showing an embodiment using a guiding stay and FIG. 4B being a side view showing an embodiment using a guiding plate of a separate member type.
Figure 4B:
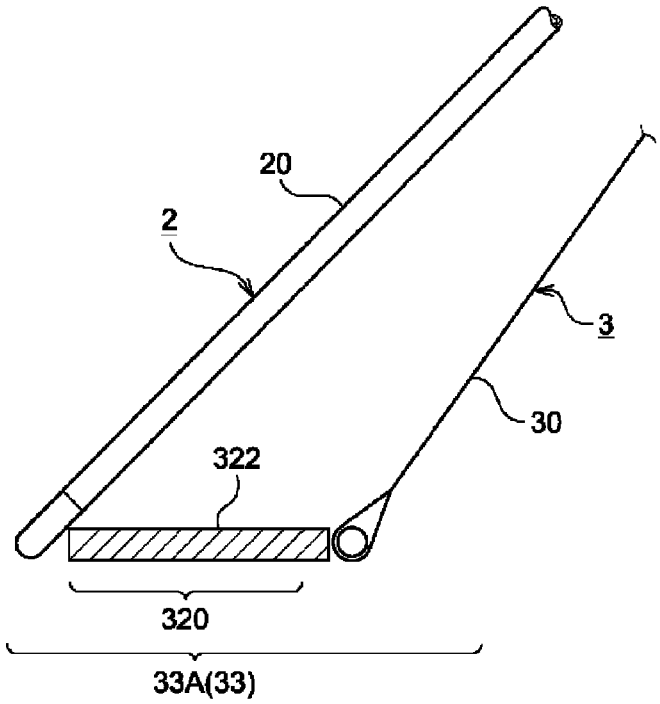

The hit ball receiving sheet 3 is configured such that a range thereof except for a lower region thereof is used as a hit ball receiving portion 32 and a returning hit ball guiding structure 33 is provided in the lower region. Specifically, a first guiding structure 33A of the returning hit ball guiding structure 33 has such a structure that one of the adjusting hooks 260 in the guiding stay 26 is selected and utilized and the vicinity of a lower end of the hit ball receiving sheet 3 is pulled further downward by the spreading spring s and a spreading face of the lower end region in the sheet main body 30 is set so as to constitute a valley fold to the spread face of the hit ball receiving portion 32, and the region of the structure is defined as a guiding portion 331. Of course, as shown in FIGS. 4A and 4B, such a configuration can be adopted that a guiding plate 322 is provided on the region so as to overlap on the region (FIG. 4A), or another guide plate 322 is provided as a separate member without bending the sheet main body 30 (see FIG. 4B). Further, though not illustrated, such a configuration can be adopted that a sheet constituting a guiding portion 331 is constituted as a shape of a pocket and a guiding plate 322 is inserted into the pocket.

Incidentally, a boundary between the hit ball receiving portion 32 and the guiding portion 331 in the sheet main body 30 when it is pulled downward utilizing the guiding stays 26 at both left and right side ends of the boundary is put in an inward bent state as viewed from a top face of the sheet main body 30, namely, a valley fold, and is obtained as a smooth curved portion without having any angular portion.

Incidentally, the hit ball receiving sheet 3 can have a rebound-preventing flap 34A or a ball receiving a curtain sheet 34B for the hit ball b1 at a near side end portion of the guiding portion 331, as shown by virtual lines in FIG. 2. That is, the rebound-preventing flap 34A is configured, for example, such that a fixed nerve is achieved by stacking a plurality of materials constituting the hit ball receiving sheet 3 one on another and the stacked materials are spread approximately horizontally from the near side of the peripheral frame portion 20 so that the hit ball b1 is prevented from directly hitting at the peripheral frame portion 20 to return to the side of the player P in a rebounding manner.

Further, the ball receiving curtain sheet 34B is for receiving the hit ball b1 so as not to fly out forward when the hit ball b1 flies further below the hit ball receiving sheet 3.

Next, the turning guide portion 4 provided at the upper end portion of the hit ball receiving sheet 3 will be described.

Figure 5:
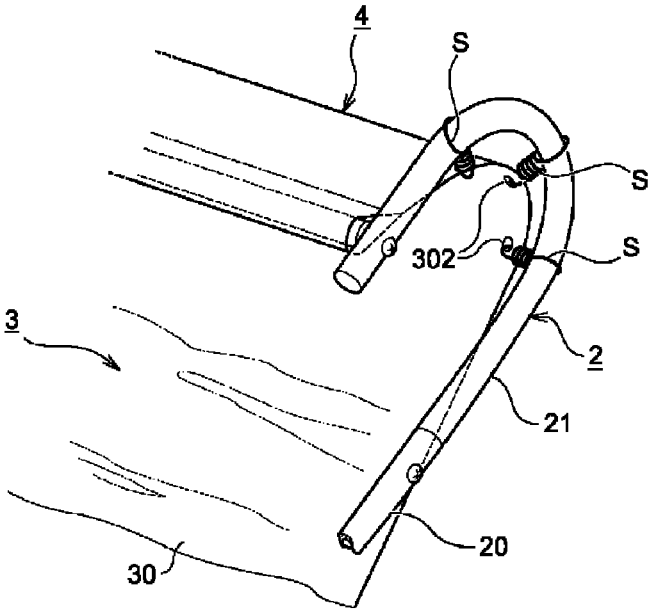
FIG. 5 is a perspective view showing a structure of the turning guide portion.

As the most basic embodiment, as shown in FIG. 5, there is a structure where the upper end of the sheet main body 30 is further extended, the extended portion is supported at respective regions of a turning frame 21 provided on the sheet supporting frame 2 through spreading springs s, and the sheet itself is spread in a state curved toward the near side in an eave shape.

Figure 6A:
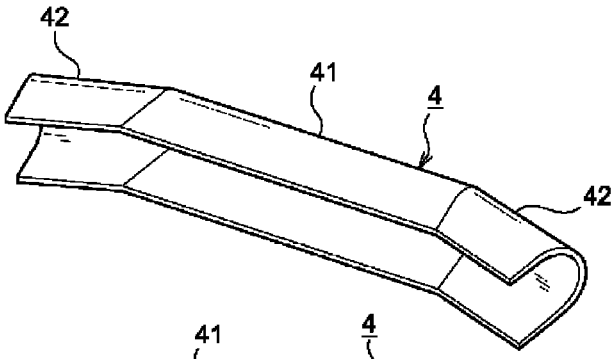
FIGS. 6A and 6B are a perspective view and a sectional plan view showing a structure of the turning guide portion.
Figure 6B:
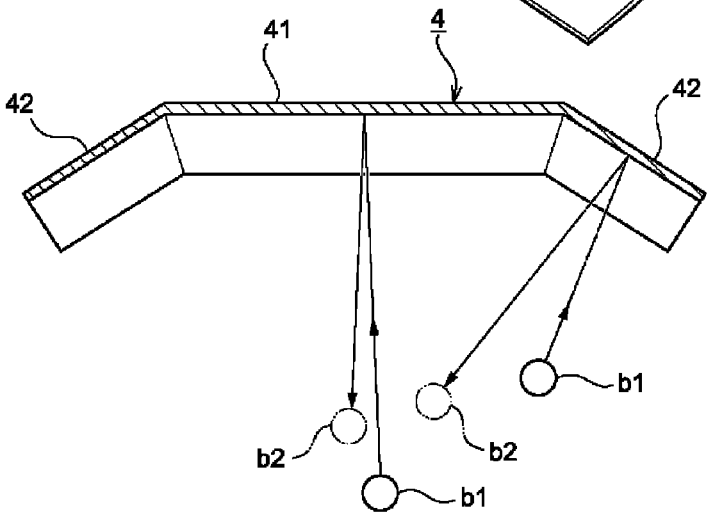

Of course, the turning guide portion 4 is not limited to such a configuration, and as the turning guide portion 4, a separate turning guide trough 41 can be used, as shown in FIG. 6. The turning guide trough 41 is composed of a material such as hard resin having a sufficient coefficient of restitution, and it can be formed with deflection guiding portions 42 by bending portions of the turning guide trough 41 positioned near left and right end thereof inward.

This is a method where the returning direction of the hit ball b1 which has reached the turning guide portion 4 is changed by the turning guide portion 4 and change of a returning position on the base face B is finally performed. Of course, it is preferred that such a deflection guide portion 42 is formed in the turning guide trough 41 which is hard, but even if the turning guide portion 4 is composed of the sheet main body 30, it goes without saying that the deflection guide portion 42 can be formed by adjusting the spreading state of the sheet main body 30.

Further, when the turning guide trough 41 which is hard and is large in coefficient of restitution is used, such a configuration can be adopted that a material having a low restitution is always or if necessary spread on a turning guide face of the turning guide trough 41 so that change of a ball speed is obtained.

The most basic configuration of the tennis training apparatus A of the present invention is as described above, and a ball-hitting training is performed in the following manner.

First of all, this apparatus is installed at a position where a proper training space can be secured. In an installation of the apparatus, when the leg portions 10 of the base stand 1 are foldable, the leg portions 10 are expanded to a self-standing state and the sheet supporting frame 2 is then set in a state where its distal end ascends at a proper inclination angle.

In this state, a player P hits a ball toward the hit ball receiving sheet 3 with his/her racket. The hit ball b1 is received by the hit ball receiving portion 32 on the hit ball receiving sheet 3 but it further advances on the hit ball receiving sheet 3 to reach the turning guide portion 4 positioned at the upper portion of the hit ball receiving sheet 3 by momentum of the hitting. Here, the ball b1 is guided to the curved portion eave-shaped of the turning guide portion 4 to drop on the hit ball receiving portion 32 on the hit portion receiving sheet 3 as a returning hit ball b2. Then, the returning hit ball b2 changes its flying-out state to an approximately horizontal or slightly rising state at the vicinity of the lower end of the hit ball receiving portion 32 by the guiding portion 331 in the hit ball guiding structure 33 and it drops on the base face B in the state to bound at an extremely close distance from the player P, as shown in FIGS. 1 and 2. The player P continues to train by hitting the ball b2 which has bounded in this manner again. In the present invention, since the returning hit ball b2 always bounds on the base face B accurately due to action of the hit ball guiding structure 33, the player can practice their hitting to acquire an ideal hitting form. Further, when the returning position of the returning hit ball b2 at this time is changed, a flying-out situation of the returning hit ball b2 is changed by changing a pulling state utilizing the adjusting hooks 260 causing the guiding portion 331 to appear or changing the spreading angle of the guiding portion 331.

At this time, when the deflection guide portions 42 are provided at both of the left and right ends of the turning guide portion 4, a player P with further high skill can train with higher difficulty level by hitting the ball toward the vicinity of one of both ends of the apparatus. That is, the hit ball b1 is changed to a returned hit ball b2 changing a returning direction thereof while being turned over by bending of the deflection guide portion 42, so that the player P hits the returned hit ball b2 back, where such a state that returned balls from various directions by an opposing player in an actual game can be obtained. As a result, the player P can train with a high level.

Other Embodiments

The present invention includes the embodiment described above as an embodiment based upon a basic technical idea, but the following modifications are proposed in the present invention.

First, an embodiment shown in FIG. 7 is an embodiment where a returned hit ball b2 for a relative beginner is obtained. That is, a separate upper face guide sheet 35 is prepared as a second guiding structure 33B, and it is spread so as to cover the sheet main body 30 in its widthwise direction utilizing the stays for the guide sheet 27. The upper face guide sheet 35 is disposed such that its distal end portion overlaps with the sheet main body 30 so as to come in contact with the hit ball receiving sheet 3, and the spreading angle thereof is adjusted to an inclination shallower than the spreading angle of the hit ball receiving sheet 3 or such an inclination that the near side of the upper face guide sheet 35 rises. When such a configuration is adopted, a ball hit by a player P which has passed through the upper face of the upper face guide sheet 35 is received by the hit ball receiving portion 32 in the sheet main body 30 positioned above the upper face guide sheet 35 and it turns at the turning guide portion 4 to return back in the same manner as the previous basic embodiment, but the ball returns on the upper guide sheet 35 to drop from a higher position on the base face B to bound at the returning time. Since the returned hit ball b2 bounds high in this manner, the player P can obtain the returned hit ball gently bounding high, so that a beginner player P can train in conformity with his/her skill. Further, even when the hit ball b1 hit by the player P has passed through the lower face of the upper guide sheet 35, the distal end of the upper face guide sheet 35 is simply caused to overlap with the sheet main body 30 of the hit ball receiving sheet 3 without being caused to be bonded to the sheet main body 30, so that the hit ball b1 can pass through between the upper face guide sheet 35 and the sheet main body 30, while the returned hit ball b2 passes on the upper face of the upper face guide sheet 35 to return back necessarily, which results in a gentle returned hit ball b2, as shown in FIG. 7.

The following aspects can be further adopted as a whole configuration.

Figure 8:
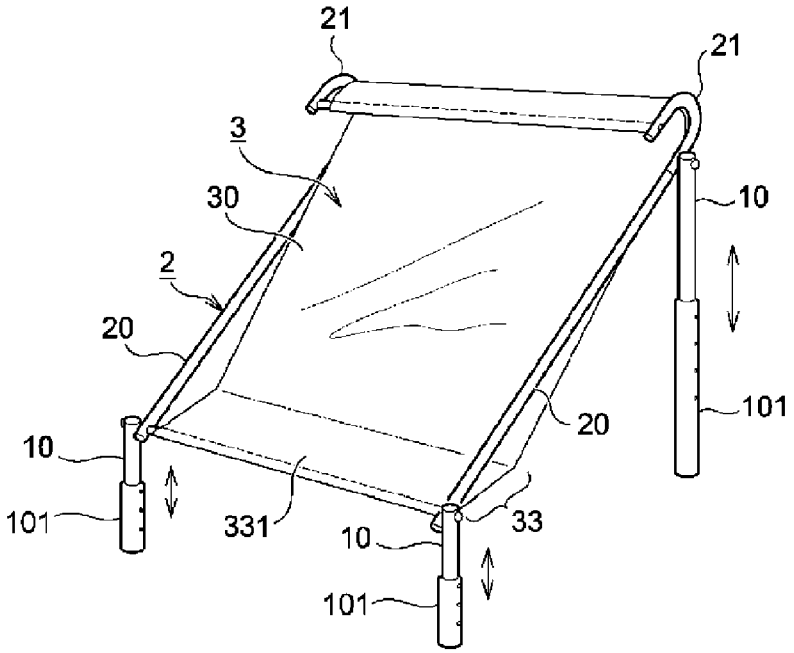
FIG. 8 is a perspective view showing another embodiment regarding a base stand.

First, an embodiment shown in FIG. 8 is an embodiment where leg portions 10 of a base stand 1 are directly provided at four corners of a sheet supporting frame 2, where the leg portions 10 positioned on the side of a player P are short while the leg portions 10 positioned on the turning guide portion 4 are long. Further, it is preferred that each of the leg portions 10 has an adjusting mechanism 101 which allows height selection of the leg portion 10.

Figure 9:
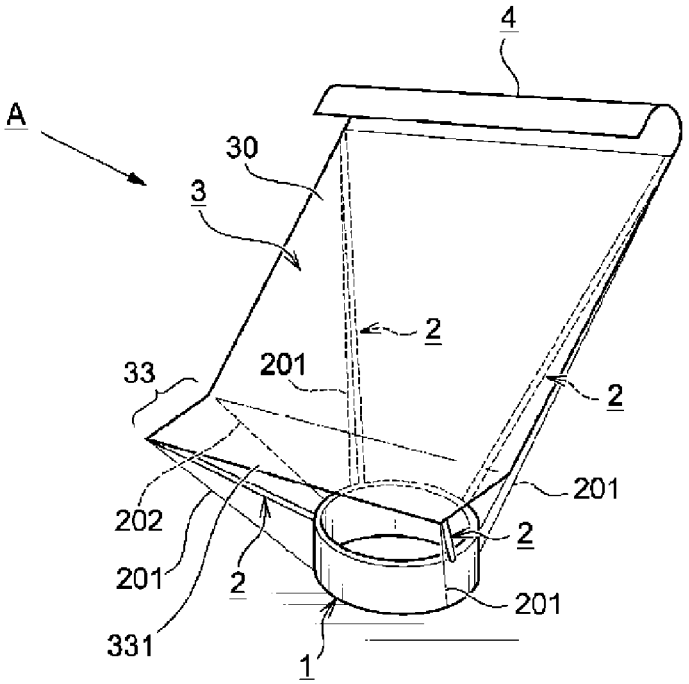
FIG. 9 is a perspective view showing still another embodiment regarding the base stand.

As still another aspect, such a configuration can be adopted that the sheet supporting frame 2 is not formed in a frame shape. For example, an embodiment shown in FIG. 9 is such that four rod-shaped sheet supporting frames 2 are provided from a base stand 1 having a sufficient weight radially upward, the hit ball receiving sheet 3 are attached to the sheet supporting frames 2 so as to be supported at the respective four distal ends of the sheet supporting frames 2, and spread nets 201 are further provided for stable setting of the sheet supporting frames 2. Further, a guiding spread net 261 is provided at a lower portion of the hit ball receiving sheet 3 so that a guiding portion 331 is set.

Figure 10:
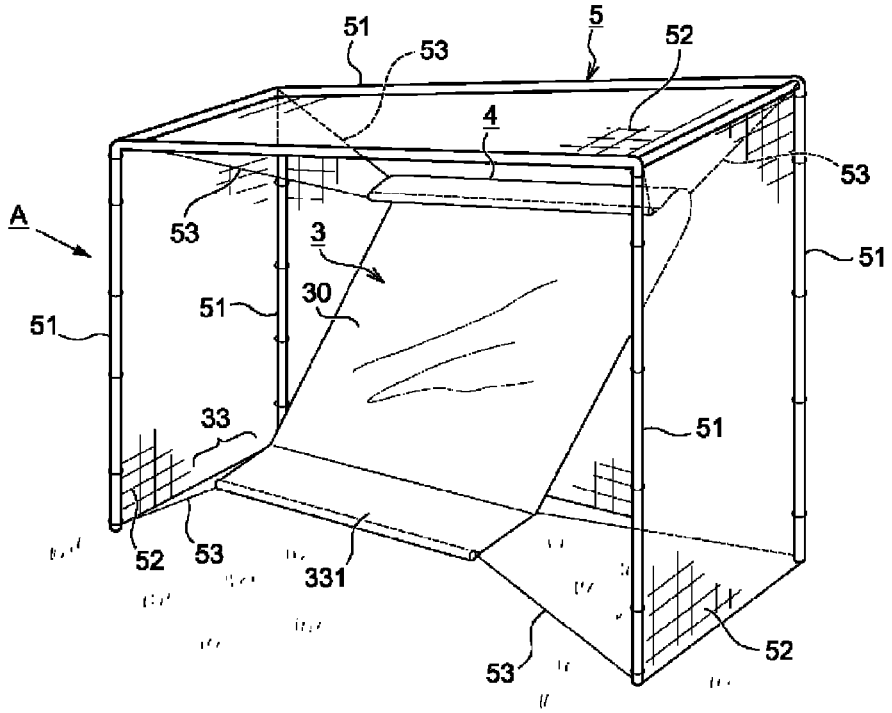
FIG. 10 is a perspective view showing another embodiment regarding the sheet supporting frame.

Further, an embodiment shown in FIG. 10 is an embodiment where even the sheet supporting frame 2 with a dedicated shape has been removed, and the sheet supporting frame 2 is configured utilizing a separate ball-catching net apparatus 5. That is, such a configuration can be adopted that only the hit ball receiving sheet 3 is provided in a hanged state by utilizing apparatus frames 51 in the ball-catching net apparatus 5 having a sufficient ball-catching size as sheet supporting frames. That is, a plurality of supporting straps 53 are installed inside a space enclosed by nets 52 and the hit ball receiving sheet 3 is formed in an inclination state by hanging the hit ball receiving sheet 3 from the apparatus frames 51 properly.

Figure 11:
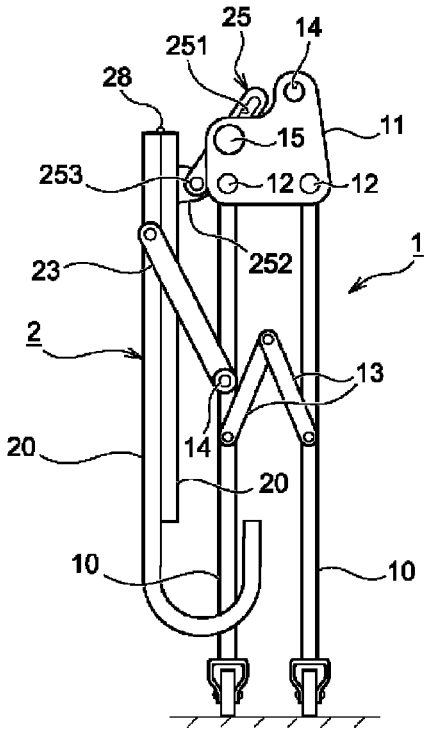
FIG. 11 is a side view showing another embodiment of a foldable base stand.

Further, the sheet supporting frame 2 can be configured to be foldable in view of convenience of an actual use thereof. An embodiment shown in FIG. 11 is configured such that the sheet supporting frame 2 is foldable at the vicinity of an intermediate portion thereof via hinges 28. When such a configuration is adopted, the sheet supporting frame 2 is put in a reduced thickness state according to folding of the leg portions 10, so that convenience of movement can be achieved.

In such a case, of course, a caster is attached to one or each of both of leg portions 10 in order to improve the convenience of movement, so that the sheet supporting frame 2 can be moved according to the so-called caster rolling. Incidentally, when the sheet supporting frame 2 is made movable and compact, such an aspect can be adopted that when a tennis coach coaches a plurality of players P, some training apparatuses are collectively carried to a training place utilizing a vehicle or the like, the training apparatuses are developed in the training place, and the players P train while their training spaces are secured.

EXPLANATION OF REFERENCE NUMERALS

1: base stand
2: sheet supporting frame

3: hit ball receiving sheet
4: turning guide portion
5: ball-catching net apparatus
10: leg portion
11: frame supporting bracket
12: leg top portion fulcrum
13: leg portion brace
14: frame-fixing fulcrum
15: frame-adjusting fulcrum
151: fixing bolt
101: adjusting mechanism
2: sheet supporting frame
20: peripheral frame portion
201: spread net
21: turning frame
23: fixing and connecting frame
25: adjusting and connecting portion
250: connecting plate
251: long hole
252: bracket
253: pin
26: guiding stay
260: adjusting hook
261: spread net for guiding
27: stay for a guide sheet
28: hinge
3: hit ball receiving sheet
30: sheet main body
301: mounting loop
302: metal eyelet
31: strap
32: hit ball receiving portion
33: returning hit ball guiding structure
33A: first guiding structure
33B: second guiding structure
331: guiding portion
322: guiding plate
34A: rebound-preventing flap
34B: ball-receiving curtain sheet
35: upper face guide sheet
4: turning guide portion
41: turning guide trough
42: deflection guide portion
5: ball-catching net apparatus
51: apparatus frame
52: net
53: supporting strap
A: tennis training apparatus
B: base face
b1: hit ball
b2: returning hit ball
P: player
R: racket
s: spreading spring

The invention claimed is:

1. A tennis training apparatus comprising:

a sheet supporting frame comprising a left frame structure and a right frame structure, each at an incline from a front to a back;

a hit ball receiving sheet comprising a bottom edge and a top edge, the hit ball receiving sheet supported between the left frame structure and the right frame structure so as to slope from the bottom edge to the top edge with a horizontal fold between the bottom edge and the top edge; and a returning guide portion provided at an upper end of the hit ball receiving sheet in an eave shape curved toward a near side when viewed from the side, wherein due to the eave shape the top edge of the hit ball receiving sheet is not a highest point of the hit ball receiving sheet; and a first guiding structure between the fold and the bottom edge formed in such a manner as to smoothly curve without having any angular portion, whereby a player is able to select from one or more returning positions by changing an angle between the fold and the bottom edge, wherein a hit ball hit by the player is received by the hit ball receiving sheet, the hit ball moves upward along the hit ball receiving sheet and is then returned by the returning guide portion to move downward along the hit ball receiving sheet to the first guiding structure to fly out of the first guiding structure as a returned ball, wherein the returned ball bounces on a base face of a training place to return again to near the player, and the returned ball is hit back by the player to the hit ball receiving sheet to continue a training.

2. The tennis training apparatus according to claim 1, further comprising a second guiding structure supported by a guide stay to stretch between the left frame structure and the right frame structure in a middle of the hit ball receiving sheet, the second guiding structure having a second left side, a second right side, a second front edge and a second back edge, wherein the second front edge is supported by the guide stay to have a stretched angle shallower than a stretched angle of the hit ball receiving sheet, and the second back edge overlaps with the hit ball receiving sheet.

3. The tennis training apparatus according to claim 1, wherein the returning guide portion is formed of a hard material having a large coefficient of restitution.

4. The tennis training apparatus according to claim 1, wherein the returning guide portion is provided with a deflection guide portion changing a returning direction of the returning hit ball.

5. The tennis training apparatus according to claim 4, wherein the deflection guide portion is provided near one or each of both of left and right end portions of the turning guide portion in a widthwise direction of the turning guide portion.

* * * * *